United States Patent [19]

Allo

[11] 4,122,610

[45] Oct. 31, 1978

[54] CUTTING GAUGE OR GUIDE

[76] Inventor: Lolotte M. Allo, 714 Fox Hunt La., Warminster, Pa. 18974

[21] Appl. No.: 826,431

[22] Filed: Aug. 22, 1977

[51] Int. Cl.[2] ..... B27G 23/00

[52] U.S. Cl. ..... 33/186

[58] Field of Search ..... 33/186; 30/233

[56] References Cited

U.S. PATENT DOCUMENTS

| | | | |
|---|---|---|---|
| 796,769 | 8/1905 | Stimpson | 33/186 |
| 839,669 | 12/1906 | Stonnell | 33/186 |
| 1,427,266 | 8/1922 | Dabney | 33/186 |

FOREIGN PATENT DOCUMENTS

| | | | |
|---|---|---|---|
| 804,517 | 10/1936 | France | 33/186 |

*Primary Examiner*—Richard E. Aegerter
*Assistant Examiner*—Willis Little
*Attorney, Agent, or Firm*—Thomas M. Ferrill, Jr.

[57] ABSTRACT

A unitary cutting guide or gauge is provided for engaging the lower blade of a pair of shears and establishing any one of several pre-selected widths of cut, the gauge having a series of perforations at selected distances from the cloth edge guide portion so as to enable the user to select the width needed in a given instance.

3 Claims, 3 Drawing Figures

CUTTING GAUGE OR GUIDE

The present invention relates to guides and aids for cutting cloth and the like, and is particularly concerned with an improved gauge for aiding in cutting cloth along any of several predetermined distances from the edge of the fabric.

Various prior gauges have been designed to permit full-range blade action of a pair of shears while also admitting of continuous range adjustability. Usually such devices require an assembly of two or more elements connected to each other, and arranged for sliding and clamping action therebetween. Related prior patents which have come to applicant's attention are:

| Pat. No. | Issued | Patentee(s) |
|---|---|---|
| 599,659 | Feb. 22, 1898 | L. V. Moulton |
| 959,464 | May 31, 1910 | O. B. Cole & J. E. Wright |

An object of the present invention is to provide a simple, compact, unitary gauge so arranged as to be fitted onto shears with a minimum of effort and to enable the user to cut fabric or light material along any of several desired cutting lines parallel to an edge or to a fold along a line in the cloth.

Another object is to provide a cutting guide which avoids the complexities of plural interrelated parts and thereby enables the user to use the guide without necessity of adjusting and clamping together plural parts.

In line with meeting these objects, applicant has provided a relatively thin unitary gauge arranged with a plurality of clamp openings each selectably adapted to be fitted on the lower blade of a pair of shears. The unitary gauge also includes a downwardly sloped portions which forms a hook-like end for engaging one edge of the cloth. The several openings are provided with gauge or distance markings to enable the user, without reference to any separate measuring device, to insert the lower blade of the shears in that opening which will provide the desired width of cut of a strip of cloth.

Each opening may if desired extend above the cutting edge of the lower blade of the shears so that the blade is surrounded by the guide unit, as shown in the drawings. This prevents the shears from totally closing, but enables the shears to be used for a substantial cutting stroke which may, for example, involve as much as two or more inches of shearing action with each stroke.

The invention will be better understood by reference to the drawings wherein.

Figure 1:
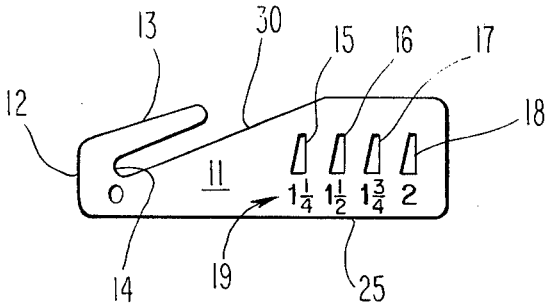
FIG. 1 is a front elevation of the gauge.
Figure 1A:
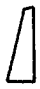
FIG. 1A is an enlarged detailed view of one opening of the gauge.

Referring now to FIGS. 1 and 1A, the gauge 11 consists of a single unitary piece of material such as sheet metal, and may be of a thickness such as 0.059 inch. The overall size of this gauge may be of the order of ¾ inch × 2½ inches, the gauge in the illustrated embodiment being flat. In the left-hand half of the gauge 11 there is formed a hook-like guide end having an upwardly extending portion 12 and an inclined portion 13 which is to reach back over the border of the cloth. The upwardly extending portion 12 and the inclined portion 13 of the gauge 11 form an end limiting location 14 for engaging the edge of the cloth.

Also formed in the gauge 11 are a plurality of openings 15, 16, 17 and 18. Each of these openings is tapered from a wider configuration at the base to a narrower configuration at its upper end. Associated with these openings are a scale of dimensions 19 stamped in the face of the gauge. Preferably, such width designations may be stamped in both faces of the gauge, so as to be conveniently readable from either side.

The form of the openings is shown in enlarged view in FIG. 1A. As will be seen there, the maximum width of the opening is substantially at the bottom thereof, and the opening is tapered generally in accordance with a typical taper of the cross-section of the lower blade of a pair of shears.

Figure 2:
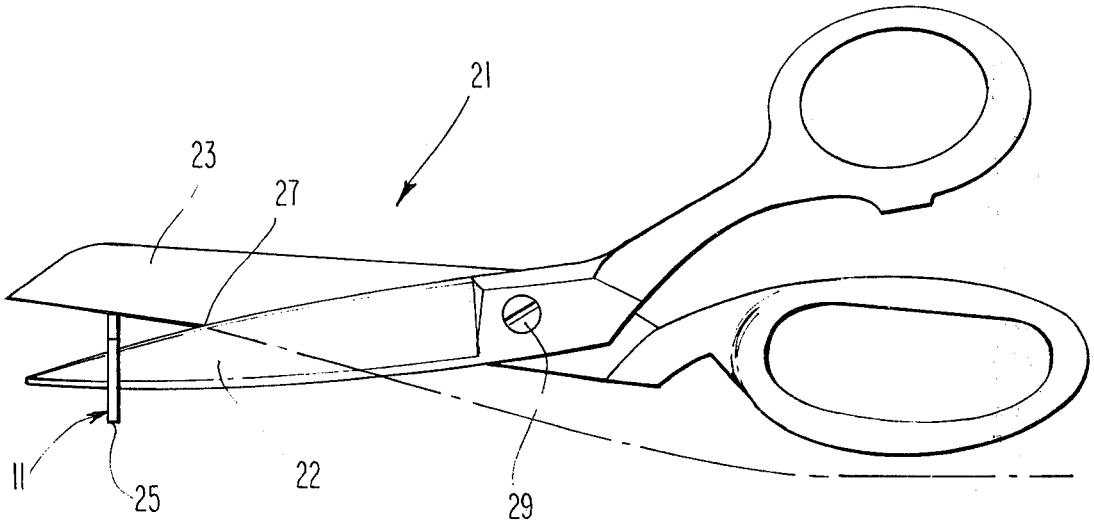
FIG. 2 is a view of the gauge as installed on a pair of shears, the shears being shown in side elevation and the gauge being shown in end view.

Referring now to FIG. 2, a pair of shears 21 is shown having a lower blade 22 and an upper blade 23. The gauge 11 is shown fixed on the lower blade 22, said blade having been thrust into the desired opening in the gauge 11 to the point of causing the gradual taper of thickness and width of the blade 22 to be firmly seated in that hole of the gauge which is at the desired cutting width location.

If desired, the straight bottom edge 25 of the gauge 11 may rest upon the surface of a work table during the cutting action with the shears.

In the position shown in FIG. 2, the shears are shown at the position of maximum closure which is permitted by a gauge with the fully closed slots each arranged to surround the end of the lower blade. The cutting action with the shears is accomplished by opening the shears to a substantially wider position and reclosing the shears down to the point of contact or near-contact with the upper edge of the gauge, this action being repeated as the shears are caused to proceed along the cloth on the desired line parallel to the edge thereof.

The primary cutting action of the shears 21 occurs in any event in the range between the point of contact 27 shown in FIG. 2 and the points of blade edge contact substantially nearer to the hinge screw 29. The alternate closing and opening cutting strokes with the shears provide the most efficient cutting action in this region.

The openings 15, 16, 17 and 18 may be provided at intervals other than ¼ inch intervals, and if desired may be placed at other spacings than shown relative to the cloth edge guide portion 14 of the gauge 11. Likewise, a greater or smaller number of openings may be provided.

The gauge 11 may be held in the position as shown in FIG. 1 in the operator's left hand when the lower blade 22 of the shears is inserted in the desired gauge opening, for cutting at a predetermined distance from the left edge of the cloth. When shears for a left-handed person are used, the gauge position may be reversed, so as to extend to the right from the shears and provide a gauged cut parallel to the right-hand edge of the material.

One feature of the present invention is the ease with which the gauge is used, and its compactness. This gauge is completely free from any tendency toward slippage which can result when a cutting gauge consists of two or more parts arranged for movability of one part relative to the other.

By virtue of the limited blade action of the shears when the gauge of FIG. 1 is in place thereon as shown in FIG. 2, the cutting action of the shears is restricted substantially to prevent the cut from coming up to the transverse plane of the gauge 11. Accordingly, the cloth remains intact not only ahead of the gauge 11 but for an appreciable distance back of the gauge. Hence, the gauge is at all times engaging the cloth in an uncut region thereof, and providing better guidance than if the cut extended all the way up to the gauge location.

The hook-like portion of the gauge formed by the upwardly extending portion 12 and the inclined portion 13 could be differently configured. However, the portion 13 extending back substantially parallel to the downwardly sloped portion 30 of the gauge tends to hold the cloth in the correct positional relation to the gauge.

While the invention has been described with reference to a preferred embodiment and certain modifications thereof, it will be apparent that other modifications may be made therein within the scope of the invention as defined by the following claims.

What is claimed is:

1. A unitary cutting guide for use with a pair of shears, said guide comprising a unitary piece of material having a generally elongated shape defining first and second opposite faces, each of said faces having a first dimension substantially larger than a second perpendicular dimension, guide means adjacent one shorter dimensioned edge of said material, said guide means including a first inner surface extending between said faces in a direction parallel to said one shorter dimensioned edge and a first pair of inner surfaces extending between said faces of an angle to said one shorter dimensioned edge to define a slot having an opening adjacent one larger dimensioned edge of said material in which cloth can be received, a series of spaced apart openings extending between said faces in which one blade of a pair of shears can be received, each of such openings being at a predetermined spaced apart distance from said first inner surface.

2. A unitary cutting guide in accordance with claim 1 wherein each of said openings is formed by a second inner surface generally parallel to and adjacent the other larger dimensioned edge of said material and a second pair of inner surfaces extending toward each other and toward said one larger dimensioned edge of said material, said one larger dimensioned edge of material adjacent said second inner surfaces being substantially parallel thereto.

3. A unitary cutting guide in accordance with claim 2 wherein said first pair of inner surfaces extend at an oblique angle to said one larger dimensioned edge of said material.

* * * * *